US005480127A

United States Patent [19]

Choudhury et al.

[11] Patent Number: 5,480,127

[45] Date of Patent: Jan. 2, 1996

[54] APPARATUS FOR THE MELTING AND TREATMENT OF METAL

[75] Inventors: Alok Choudhury, Püttlingen; Jochen Schumann, Maintal; Harald Scholz, Rodenbach; Jan-Erwin Schindler, Sasbachwalden, all of Germany

[73] Assignee: Leybold Durferrit GmbH, Cologne, Germany

[21] Appl. No.: 347,958

[22] Filed: Dec. 1, 1994

[30] Foreign Application Priority Data

Feb. 11, 1994 [DE] Germany ..... 44 04 313.9

[51] Int. Cl.[6] ..... C21B 13/14

[52] U.S. Cl. ..... 266/143; 266/165

[58] Field of Search ..... 75/536, 537; 266/142, 266/143, 165

[56] References Cited

U.S. PATENT DOCUMENTS

| | | | |
|---|---|---|---|
| 3,411,764 | 11/1968 | Falk | 266/143 |
| 3,467,167 | 9/1969 | Mahin | 75/582 |
| 3,575,695 | 4/1971 | Miyashita | 75/537 |
| 3,885,956 | 5/1975 | Obst | 75/536 |
| 3,885,957 | 5/1975 | Richter | 75/537 |
| 4,814,006 | 3/1989 | Gorjup et al. | 75/59.12 |
| 5,196,157 | 3/1993 | Inoue | 266/143 |

OTHER PUBLICATIONS

Swaney et al. "Development of a small sized ladle metallurgy system" Metallurgical Plant and Technology International May 1990 pp. 64–73.

*Primary Examiner*—Melvyn Andrews
*Attorney, Agent, or Firm*—Felfe & Lynch

[57] ABSTRACT

In a method for melting and treating metals and metal alloys, especially steels, solid charge material is melted in a ladle. Then while passing a gas through the melt at least part of the time, at least one of the treatments of decarburization, dephosphorization, deoxidation, desulfurization, alloying and removing nonmetallic inclusions is performed in the same ladle. An apparatus for the practice of the method has two tracks (W1, W2) for the ladle (5), which are aligned in an approximate T-shape to one another, a preheating station (9) and a slag removal station (14) being arranged in the top part of the T and, at the intersection between the top part and the stem between the preheating station (9) and the slag removal station (14), the first treatment station (10) with a heating system is disposed, and at the free end of the stem of the T a second treatment station (16) for the vacuum treatment is disposed.

9 Claims, 2 Drawing Sheets

12
13
10
15
7
3
1
W1
A
6
A
11
6
1
19
14
15a
18
W2
20'
20
A
4
16
6
3
17
2
W3
5
7
2
6
A

APPARATUS FOR THE MELTING AND TREATMENT OF METAL

BACKGROUND OF THE INVENTION

The invention relates to a method for the melting and treatment of metals and metal alloys, especially steels, in the form of solid charge material in metallurgical vessels with the input of electrical energy.

The charge material in this case is especially scrap in pieces. Formerly the procedure has been to melt down the solid charge material in an electric arc furnace, decarburize it, dephosphorize it and roughly alloy it. After the desired temperature is reached the melt, which is quite largely slag-free, is tapped into a ladle. Then a reactive flux mixture, which can consist, for example, of a mixture of CaO and $CaF_2$, is fed to the melt in the ladle. Then, in the further treatment of the melt, the ladle is heated in an electric ladle furnace to compensate temperature losses. If it should be necessary, the melt is alloyed during this heating phase to achieve the desired chemical composition.

Depending on the specifications given the melt is degassed in a degassing apparatus. In the production of low-carbon alloys of high chromium content the melt is blasted with oxygen in the degassing apparatus and decarburized under reduced pressure (the so-called VOD process). In the VOD process, the heating in the ladle furnace is usually omitted, since sufficient heat is formed during decarburization by the exothermic carbon monoxide reaction. After this treatment is completed the melt is cast either by the strand-casting or by the teeming method.

This long-common practice, however, has the following disadvantages: First of all, a special melting apparatus, such as an electric arc furnace is required. This involves high first costs, additional space for the furnace, an extensive stock of replacement parts and additional consumption of refractory material for preparation and lining of the oven. Furthermore, personnel costs for the furnace crew are considerable. While the furnace is being prepared or serviced there is a loss of production. When the furnace is tapped into the ladle additional heat losses occur, which have to be compensated in the ladle furnace.

The proposal has never before been put forward that the entire melting process, i.e., the use of solid charge material, be performed in a single crucible, which is referred to also as a transfer ladle. Transfer ladles have as a rule been filled with metal that is already molten, and then many different treatments are performed in the ladle.

DE-OS37 22 167 has already disclosed the melting of solid material in a ladle, which consists of a so-called consumable electrode. For this purpose it is also necessary first to charge the ladle with molten metal, and the melting of the consumable electrode is done only for the purpose of feeding certain substances to the metal, such as additional alloying elements. The amount of metal fed via the consumable electrode amounts to only a fraction of the total amount of metal.

SUMMARY OF THE INVENTION

The invention therefore is addressed to the problem of substantially simplifying a method of the kind described in the beginning, thus saving thermal energy, and also of drastically reducing the first costs of the apparatus for the practice of the method.

The solution of the stated problem is accomplished in accordance with the invention, in the method described in the beginning, by melting the charge of material in a ladle and, while passing a gas through the molten metal at least for a period of time, performing in the same ladle at least one of the treatments of decarburization, dephosphorization, deoxidation, desulfurization, alloying and removing nonmetallic inclusions.

The method of the invention makes it possible to dispense entirely with a special melting furnace, such as an electric arc furnace. Instead, according to the invention, the solid charge material is melted in the treatment ladle itself by the input of energy. The melting energy can be put in various ways, for example by means of electric arcs and/or plasma and/or induction heating. Also the metallurgical treatments, such as decarburization, dephosphorization, deoxidation, desulfurization, alloying, and removing nonmetallic inclusions, which heretofore were commonly performed in the melting unit, can be performed in the same ladle, according to the invention. The further treatment of the melt can take place under the conditions known heretofore. In addition to reducing costs, the invention also provides the additional advantage that the temperature losses during the further treatment are very slight, since the lining of the ladle is heated up in the course of the melting and is almost in thermal equilibrium with the melt. A special advantage of the invention is that a steel mill equipped to practice it can be set up with a very efficient flow plan.

It is in this case especially advantageous if the charge material is added to the ladle in portions, each portion being melted before the next portion is added. The scrap metal is bulky, as a rule, so that the level of the molten metal will be much lower down than the topmost piece of the charge material. By adding the charge material in portions an especially good level of fill can be achieved in the ladle.

It is also especially advantageous if the entire amount of fluxing material for performing at least one step of the process is added to the ladle together with the first portion of charge material. A rule of thumb is that about 10 kg of slag-making material is needed per metric ton of the entire charge. Even if, in the case of a 20-ton ladle, only a portion amounting to 10 tons is first melted down, the entire quantity of 200 kg of flux is added before the first portion is melted. This permits an especially intense slagging reaction.

It is also advantageous to preheat the lining or brickwork of the ladle to a temperature of at least 600° C., preferably of at least 800° C., before putting in the charge material. It is especially advantageous to heat the ladle together with the first portion of the charge to the said temperature, using fossil fuels, before starting to heat with electrical energy. Due to its great ratio of surface to its bulk, the solid scrap more easily absorbs energy from the burner flames, and at the same time brings about a distribution of the hot combustion gases, so that the latter can more easily reach the ladle brickwork. In this manner the preheating is considerably accelerated.

In order likewise to assure an intense input of energy when melting down the portions it is especially advantageous, in the case of arc heating, to raise the electrodes gradually as the level of the molten metal rises, and to do the same with at least one plasma burner in the case of plasma heating. This signifies that both the electrodes and the plasma burners are to be provided with guiding means of appropriate length.

The invention also relates to an apparatus for the practice of the method. For the solution of the same problem this apparatus is characterized according to the invention by the fact that two ways for the transport of the ladle are arranged in an approximately T-shaped configuration, that in the top of the T a preheating station and a slag removal station are disposed, that the first treatment station combined with a heating system is disposed at the intersection between the top and the stem of the T, and at the bottom end of the stem of the T a second treatment station is provided for the vacuum treatment.

It is then again advantageous to dispose a bunker station for additive materials between the first and the second treatment station, from which means run for carrying the materials to both treatment stations. It is thus possible to feed additives selectively from the bunker station both to the first treatment station and to the second treatment station, so that optimum use can be made of the additives.

It is still further advantageous to arrange an operator's stand alongside the ways running between the two treatment stations. With this arrangement it is possible for the operator to have a very accurate visual supervision and control of the process.

Additional advantageous configurations of the method and apparatus will appear from the other subordinate claims.

BRIEF DESCRIPTION OF THE DRAWINGS

Two embodiments of an apparatus according to the invention will be explained hereinafter with reference to FIGS. 1 and 2.

DESCRIPTION OF THE PREFERRED EMBODIMENTS

Figure 1:
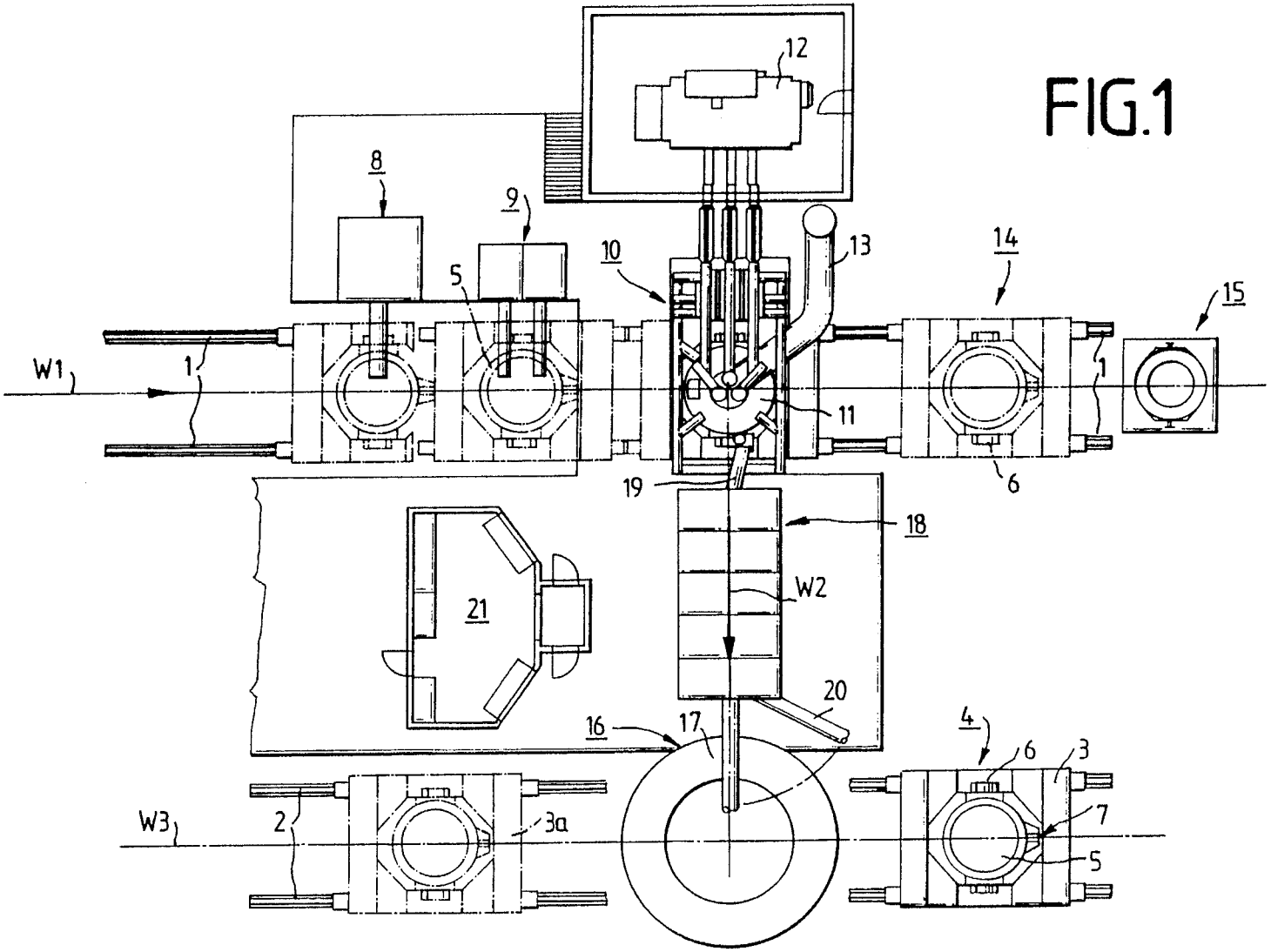
FIG. 1 shows a top plan view of a first embodiment of an apparatus according to the invention, and FIG. 2 an enlarged detail of FIG. 1 showing a differently constructed slag removal station.

In FIG. 1 there is shown an apparatus with three transport ways W1, W2 and W3, wherein the track W1 and W3 are formed by pairs of parallel rails 1 and 2. The second transport track W2 perpendicular thereto is formed by a crane for transporting the ladle.

For ways W1 and W3 the cars 3 are needed, each provided with a horizontal pivot means 4 for each ladle 5. The ladle 5 has two lateral trunnions 6 and a pouring lip 7 for teeming the contents of the ladle. FIG. 1 shows a transport car 3 with a ladle 5 in various positions (broken lines).

Alongside the first transport track W1 there is first a repair and maintenance station 8, and after that a preheating station 9 with burners, not indexed, for fossil fuels. In the preheating station 9 the ladle 5 is charged with the essential amount of the charge material and the flux. In the preheating station the ladle with its contents is preheated in the manner described above.

The preheating station 9 is followed in the direction of track W1 by a first treatment station 10 to which there belongs a ladle cover 11 through which three arc electrodes, not indexed, are passed which are connected to an electric power source 12. The ladle cover 11 is also provided with a vacuum line 13. The ladle cover 11 is suspended for raising and lowering, and consequently, when a car 3 is beneath it, it can be lowered onto a mating margin of the ladle 5. In this first treatment station 10 the melting down of the charge material and its further treatment are performed if the latter is carried out under atmospheric pressure. For the feeding of additional portions of the charge material the ladle 5 can be passed back into the preheating station 9, since in this position the mouth of the ladle is more easily accessible from above.

After the melting and after at least some of the individual process steps have been performed it may be necessary to replace the slag with another charge of flux. For this purpose, there is a slag removal station 14 further along on the first track W1, with which a slag receiver 15 is associated. In the case represented in FIG. 1 the axis A—A of the trunnions 4 is at right angles to the rails 1, so that the pouring lip 7 is pointing in the same direction as the rails. To recharge it with fresh flux the ladle 5 can be run back into the preheating station 9. But it is also possible to associate a flux bunker, not shown here, with the slag removal station 14.

The first transport track W1 and the second track W2 are arranged in a T-shape with one another, and it can be seen that the first treatment station 10 is arranged at the intersection between the top and the stem of the T. At the end of the second transport way W2 there is a second treatment station 16, which in the present case consists of a vacuum chamber 17 into which the ladle 5 can enter. Both of the treatment stations 10 and 16 are equipped with oxygen lances, but for the sake of simplicity they are not shown in the drawing. Instead of the vacuum chamber 17 an additional ladle cover can be provided, which is connected via a suction line to a pump set and can be placed on the upper edge of the ladle to seal it hermetically.

Between the first treatment station 10 and the second treatment station 16 there is a bunker station 18 which consists of numerous individual chambers in which the various materials to be added to the melt are contained. From these bunker stations 18 conveyors 19 and 20 run to the individual treatment stations. These conveyors can be in the form of chutes or tubes. The conveyor 20 associated with the vacuum chamber 17 can swivel laterally so as not to interfere with the entry of the ladle 5 into the vacuum chamber 17.

Two more cars 3 and **3*a* are on track 2 and the ladle 5 can be placed on them after it is lifted out of the vacuum chamber 17**. From this point the ladle can be brought into an ingot casting or continuous strand casting station for teeming.

Alongside the second transport track W2 and bunker station 18 is an operator's platform 21, and it can be seen that the operator has a complete view from here of the apparatus and the course of the process, with the exception only of the slag removal station 14 which, anyway, has to be under the control of another operator.

It is also to be mentioned that the ladle, known in itself and used here for a new purpose, usually has in or near its bottom one or more diffuser blocks for passing gas through the melt. This gas is usually argon and/or nitrogen. It is important that gas be driven through the diffuser blocks so as to prevent clogging by molten metal or by impurities from the molten metal.

Figure 2:
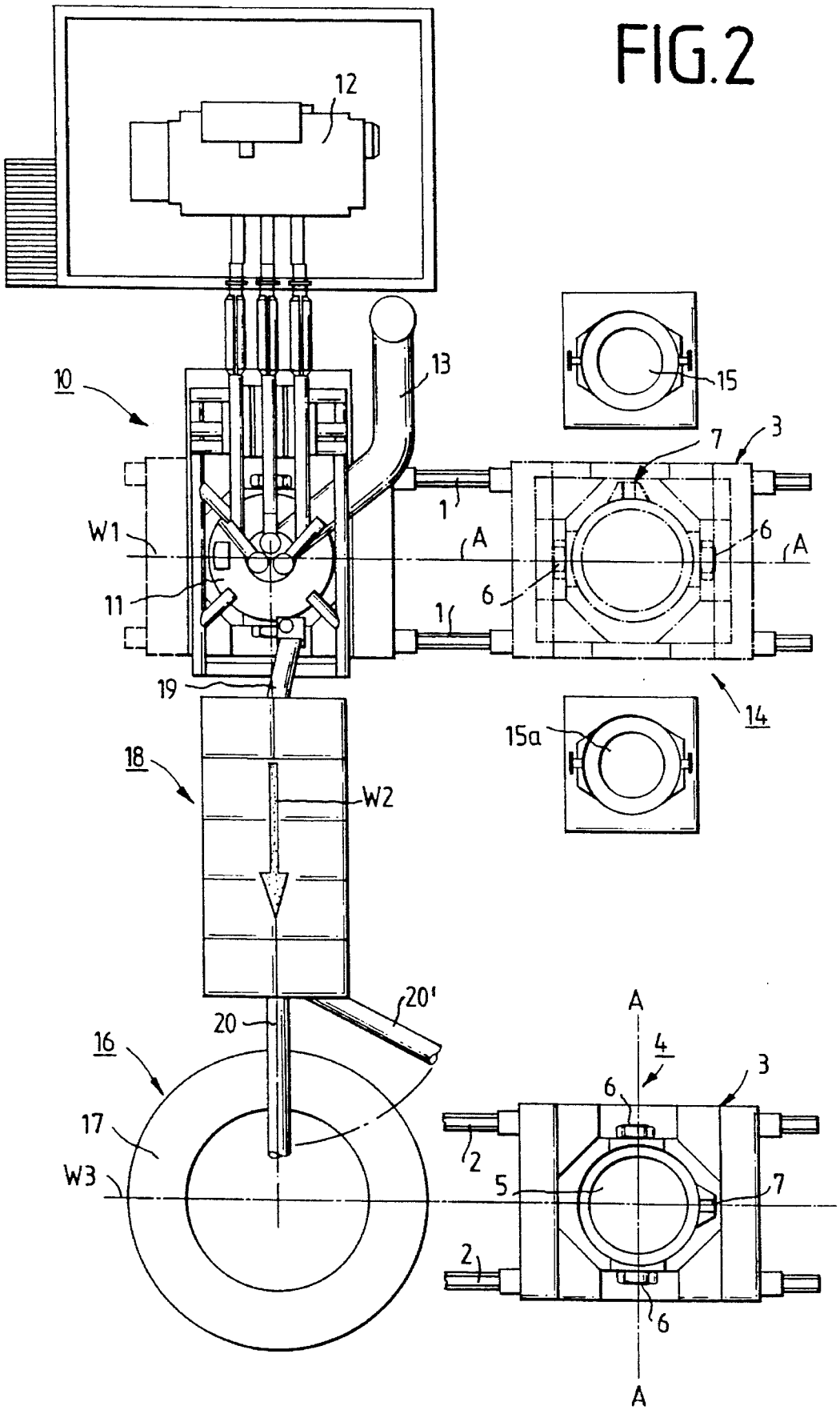

FIG. 2 shows on an enlarged scale the approximate right half of FIG. 1, but with the decided difference that the axis A—A of the trunnion mounting 4 of the cars that run on the track 1 has been turned 90 degrees about its vertical axis, so that the pivot axis A—A is now parallel to the tracks 1. Depending on which side the pouring lip 7 is arranged, it is possible to provide a slag receiver 15 or **15*a*** on one or the other side. In this way the floor surface occupied by the entire system can be reduced accordingly.

EXAMPLE 1

In an apparatus according to FIG. 1 a ladle with a capacity of 20 metric tons was filled with a first portion of 10 metric tons of shredded steel scrap with sizes between about 10 and 20 cm and a total amount of 200 kg of CaO flux, and the ladle and its contents were heated by gas burners in the preheating station to a temperature of about 950° C. The ladle was then moved into the first treatment station, where the contents were melted by means of three arc electrodes and further heated to about 1600° C. Two additional portions of 5 metric tons each, preheated to about 500° C., were added successively and completely melted down. Analysis showed the composition of the melt given in Table I, line 1.

Then the melt was blasted with an oxygen lance from above for a period of 10 minutes to remove carbon and phosphorus. An analysis yielded the results given in Table I, line 2.

Then the slag was withdrawn in the slag removal station and replaced with 200 kg of fresh flux of 80% CaO and 20% $CaF_2$, by weight. In the first treatment station alloying and deoxidizing agents, such as C, Si, Mn and Al, were added to the melt from the bunker station, and heating by arc electrodes was resumed for a period of 10 minutes. Another analysis gave the FIGURES shown in Table I, line 3.

Then the ladle was transferred to the vacuum chamber of the second treatment station and exposed for a period of 20 minutes to a pressure of less than 5 mbar; then the vacuum was broken, but the treatment was continued for another ten minutes while passing gas through the metal. The temperature of the melt was finally 1570° C. An analysis resulted in the data given in Table I, line 4. The melt was then cast to ingots directly from the ladle. The final analysis is given in Table I, line 5.

Throughout the entire melting and treatment gas was steadily passed through the melt through diffuser blocks arranged on the bottom of the ladle.

TABLE 1

| | C % | Si % | Mn % | P % | S % | Al % |
|---|---|---|---|---|---|---|
| 1 | 0.05 | 0.004 | 0.19 | 0.030 | 0.020 | 0.0 |
| 2 | 0.02 | 0.005 | 0.12 | 0.015 | 0.018 | 0.0 |
| 3 | 0.17 | 0.38 | 1.45 | 0.016 | 0.019 | 0.047 |
| 4 | 0.17 | 0.40 | 1.40 | 0.016 | 0.005 | 0.035 |
| 5 | 0.17 | 0.40 | 1.40 | 0.016 | 0.005 | 0.030 |

EXAMPLE 2

In an apparatus according to FIG. 1, for the production of an 18/8 chromium-nickel steel (AISI 304), a ladle with a capacity of metric tons was filled with an initial portion of 10 metric tons of appropriate scrap of shredded pieces with dimensions between about 10 and 20 cm and the full amount of 200 kg of CaO flux, and the ladle and its contents were heated by gas burners in the preheating station to a temperature of about 950° C. Then the ladle was shifted into the first treatment station, where the contents were melted by means of three arc electrodes and superheated to about 1580° C. Two preheated additional portions of tons each were added successively and completely melted down and brought to the temperature of likewise about 1580° C. An analysis showed the composition of the melt that is listed in Table II, line 1.

Then the melt was blasted with an oxygen lance from above for a period of 10 minutes for partial decarburization, while the temperature increased to 1620° C. Analysis showed the data listed in Table II, line 2.

Then the slag was removed in the slag removal station and replaced by 200 kg of a fresh flux of 80 weight-percent of CaO and 20 weight-percent of $CaF_2$. In the second treatment station the remaining alloying components were added to the melt from the bunker station, and the melt was subjected to a so-called VOD treatment under a vacuum between 60 and 80 mbar while being blasted with oxygen from a lance for a period of 20 minutes. 0n account of the exothermic reaction the temperature rose to 1700° C. Another analysis yielded the values given in Table II, line 3. Then at least one reducing agent from the group Al, Si and Mn was added to the melt in the vacuum chamber of the second treatment station and subjected for 20 minutes to a pressure of less than 5 mbar (the so-called VD treatment). Meantime the temperature fell to 1650° C. and the analysis data can be found in Table II, line 4.

The vacuum was then broken, but the treatment continued for another 10 minutes while argon was passed through the melt as scavenging gas, while at the same time a number of corrections were made in the alloying elements. The temperature of the melt finally came to 1610° C. Analysis gave the data in Table II, line 5. The melt was then cast to ingots directly from the ladle. The final analysis can be found in Table II, line 6.

Throughout the entire melting and treatment period scavenging gas was passed through the melt through diffuser blocks disposed in the floor of the ladle.

TABLE II

| | C % | Si % | Mn % | P % | S % | Cr % | Ni % | Al % | O % |
|---|---|---|---|---|---|---|---|---|---|
| 1 | 1.2 | 0.40 | 0.80 | 0.022 | 0.028 | 18.8 | 9.5 | — | — |
| 2 | 0.85 | 0.15 | 0.57 | 0.022 | 0.028 | 18.4 | 9.45 | 0.005 | — |
| 3 | 0.01 | 0.03 | 0.55 | 0.024 | 0.020 | 17.8 | 9.4 | 0.005 | 675 |
| 4 | 0.014 | 0.48 | 0.70 | 0.023 | 0.010 | 18.2 | 9.4 | 0.010 | — |
| 5 | 0.015 | 0.68 | 0.77 | 0.023 | 0.008 | 18.8 | 9.4 | 0.017 | 40 |
| 6 | 0.016 | 0.68 | 0.77 | 0.023 | 0.008 | 18.9 | 9.4 | 0.015 | 30 |

While there has been described what is at present believed to be the preferred embodiment of the invention, it will be apparent to one skilled in the art that various changes and modifications may be made therein without departing from the invention, and its case will be pointed out in the appended claims.

What is claimed is:

1. Apparatus for melting and treating metal comprising a ladle for holding metal, first linear track means on which said ladle can be transported, a preheating station, a first treatment station, and a slag removal station arranged serially on said first linear track means, means for melting said metal in said ladle at said first treatment station to form a melt, second linear track means which meets said first linear track means perpendicularly at said first treatment station, and a second treatment station on said second linear track means remote from said first treatment station, said ladle being transportable on said second linear track means from said first treatment station to said second treatment station.

2. Apparatus as in claim 1 further comprising bunker means located between said first and second treatment stations, and carrier means for transporting additive materials from said bunker means to said first and second treatment stations.

3. Apparatus as in claim 1 wherein said ladle comprises a horizontal pivot axis which is perpendicular to said first track means.

4. Apparatus as in claim 3 wherein said slag removal station comprises a slag container disposed to receive slag from said ladle when said ladle is pivoted on said horizontal axis.

5. Apparatus as in claim 1 wherein said ladle comprises a horizontal pivot axis which is parallel to said first track means.

6. Apparatus as in claim 5 wherein said slag removal station comprises a slag container disposed to receive slag from said ladle when said ladle is pivoted on said horizontal axis.

7. Apparatus in claim 1 wherein said second treatment station comprises means for treating said melt under vacuum.

8. Apparatus as in claim 1 further comprising third track means parallel to said first track means and intersected by said second track means, said second treatment station being located on said third track means.

9. Apparatus as in claim 1 further comprising means for passing a gas through said melt at at least one of said first and second treatment stations.

* * * * *

UNITED STATES PATENT AND TRADEMARK OFFICE

CERTIFICATE OF CORRECTION

PATENT NO. : 5,480,127

DATED : January 2, 1996

INVENTOR(S) : Choudhury et al.

It is certified that error appears in the above-indentified patent and that said Letters Patent is hereby corrected as shown below:

| | |
|---|---|
| Col. 5, line 55 | " 10 metric" should read -- 20 metric --. |
| Col. 5, line 63 | " tons " should read --`5 tons --. |
| Col. 5, line 55, | after "capacity of" please insert --20--. |

Signed and Sealed this

Tenth Day of June, 1997

Bruce Lehman

*Attest:*

BRUCE LEHMAN

*Attesting Officer*

*Commissioner of Patents and Trademarks*